US005371983A

United States Patent [19]

Kawaguchi et al.

[11] Patent Number: 5,371,983

[45] Date of Patent: Dec. 13, 1994

[54] DOME SHAPED ROOF STRUCTURE

[75] Inventors: Mamoru Kawaguchi, Tokyo; Toshimasa Hirasawa, Chiba; Tatsuo Hatato, Inzai; Akira Taga, Tokorozawa; Ikuo Tatemichi, Tokyo, all of Japan

[73] Assignee: Mamoru Kawaguchi and Maeda Corporation, Tokyo, Japan

[21] Appl. No.: 34,114

[22] Filed: Mar. 22, 1993

[30] Foreign Application Priority Data

Apr. 8, 1992 [JP] Japan ..... 4-087289
Apr. 8, 1992 [JP] Japan ..... 4-087290

[51] Int. Cl.[5] ..... E04B 7/08
[52] U.S. Cl. ..... 52/81.1; 52/223.8
[58] Field of Search ..... 52/6, 81.1, 81.2, 81.3, 52/81.4, 83, 22, 223.8; 472/92; 135/102, 104, DIG. 8

[56] References Cited

U.S. PATENT DOCUMENTS

| | | | |
|---|---|---|---|
| 4,074,502 | 2/1978 | Peter | 52/83 |
| 4,587,775 | 5/1986 | Lewis et al. | 52/65 |
| 4,706,419 | 11/1987 | Adachi et al. | 52/65 |
| 4,736,553 | 4/1988 | Geiger | 52/81.2 |
| 4,942,698 | 7/1990 | Kumagai et al. | 52/6 |
| 5,007,214 | 4/1991 | Itami et al. | 52/66 |
| 5,058,332 | 10/1991 | Masuyama et al. | 52/66 |
| 5,067,288 | 11/1991 | Takahama et al. | 52/81.2 |
| 5,079,887 | 1/1992 | Anderson | 52/22 |
| 5,259,158 | 11/1993 | Levy | 52/83 |

FOREIGN PATENT DOCUMENTS

| | | | |
|---|---|---|---|
| 772349 | 11/1967 | Canada | 20/4 |
| 0244213 | 11/1987 | European Pat. Off. | E04H 3/14 |
| 2514055 | 4/1983 | France | E04B 7/16 |
| 2645563 | 10/1990 | France | E04O 13/035 |
| 663576 | 7/1938 | Germany . | |
| 3202537 | 9/1991 | Japan | E04B 7/16 |
| 4-20637 | 1/1992 | Japan | E04B 7/16 |
| 4-27057 | 1/1992 | Japan | E04B 7/16 |
| 827718 | 5/1981 | U.S.S.R. | 52/81.2 |

*Primary Examiner*—Carl D. Friedman
*Assistant Examiner*—Kien Nguyen
*Attorney, Agent, or Firm*—Thompson, Hine & Flory

[57] ABSTRACT

A dome shaped roof structure suitable for a stadium for indoor athletic sports is disclosed. The dome shaped roof structure comprises a main frame for covering the inside of the stadium and a reinforcing frame. The reinforcing frame comprises: cables disposed in the inner side of the main frame and extended radially from the central portion of the main frame to the bottom peripheral border; circular cables disposed concentrically about the peripheral border of the main frame; and strut members that have each upper end connected to the steel member of the main frame at an intersecting point of the radiating cables and the circular cables, and the strut members vertically supported by the radiating cables and the circular cables; and wherein tension is introduced to the radiating cables in the direction of the bottom peripheral border and the outer ends of the radiating cables are fixed with the main frame, so that the steel members of the main frame are thrust up by the strut members of the reinforcing frame.

12 Claims, 8 Drawing Sheets

DOME SHAPED ROOF STRUCTURE

BACKGROUND OF THE INVENTION

1. Industrial Field of the Invention

The present invention relates to a dome shaped roof structure, and in particular, relates to a dome shaped roof structure which is suitable for a stadium for indoor athletic sports.

2. Related Art

Recently, a large-scale fixed dome shaped roof structure has been adopted in the construction of stadiums for indoor athletic sports. A steel truss structure, a cable structure or the like is generally known as a fixed dome shaped roof structure.

The steel truss structure is organized in the form of a double layer truss dome (a double layer space frame) which has a space truss structure comprising connected steel members to ensure relatively good structural stability, and a single layer truss dome (a single layer space frame) which has a plane truss structure comprising connected steel members as shown in FIG. 23. However, construction of the double layer truss dome is costly and requires a long time in order to assure good structural stability of the roof. Therefore, the single layer truss dome structure 1 is often adopted in order to lighten the weight thereof and to reduce the cost and length of construction thereof.

In contrast, the cable roof structure of a fixed dome shape, as shown in FIG. 24, comprises multiple cables 2 and 3 forming a plurality of upper and lower chord members, and a plurality of strut members 4 which are each vertically supported by the cables 2 and 3. The cables 2 to which high tension is introduced in the external direction are bound with a compression ring 5 along the bottom of the dome, i.e. the bottom peripheral edge of the dome shaped roof.

The single layer truss dome structure 1 has a problem with respect to the buckling strength of the dome construction members. For example, the dome construction members are apt to easily collapse from offset load of snow deposited on the dome shaped roof or the like. The bottom peripheral edge of the dome requires a strong tension ring 6 in order to resist the large thrust which is applied to the bottom border of the dome in the direction indicated by the arrow A in FIG. 24. Consequently, the construction costs including the tension ring 6 and the tension ring supporting means are greatly increased.

Since the cable roof structure is flexible, the above cable roof structure comprising flexible cables 2 and 3, requires a large prestress to the cable 2 in order to increase the structural stability thereof. Therefore, the border of the structure requires a strong compression ring 5 in order to resist the large thrust applied in the direction indicated by the arrow B in FIG. 24. In contrast with the case of the single layer truss dome structure 1, the construction costs including the tension ring 6 and the tension ring supporting means are greatly increased.

SUMMARY OF THE INVENTION

The present invention was developed in view of the above-described problems of the conventional dome shaped roof structure.

Therefore, an object of the present invention is to provide an improved dome shaped roof structure which enables the thrust applied to the bottom peripheral border of the dome to be decreased.

Another object of the present invention is to provide an improved dome shaped roof structure having a high structural stability, which can decrease the costs and the length of construction thereof.

In order to achieve the above-mentioned objects of the present invention, there is provided a dome shaped roof structure which can be employed in the construction of a stadium for indoor athletic sports comprising: a main frame for covering the inside of the stadium, constructed by a plurality of steel members which are connected to one another in the form of plane truss, which is arch shaped when viewed from the side and circularly shaped when viewed from above, and has a ring shaped peripheral border; and a reinforcing frame comprising a plurality of radiating cables constructed in the inner side of the main frame and extending radially from the central portion of the main frame to the periphery when viewed from above, a plurality of circular cables provided concentrically with the peripheral border of the main frame, and a plurality of strut members that have each upper end connected to the steel member of the main frame at an intersecting point of the radiating cables and the circular cables, the strut members being vertically supported by the radiating cables and the circular cables; wherein tension is introduced to the radiating cables in the external direction and the outer ends of the radiating cables are fixed with the main frame, so that the steel members of the main frame are thrust up by the strut members of the reinforcing frame.

In the dome shaped roof structure of the present invention, since the out ends of the radiating cables are fixed to the main frame while introducing tension in the radiating cables in the direction of the bottom peripheral border, tension in the opposite direction operates upon the radiating cables and the periphery of the main frame fixed therewith, as a reaction force to the thrust generated in the annular peripheral border of the main frame. The thrust given to the annular peripheral border is decreased to relieve the load of the peripheral border. Therefore, the dome shaped roof structure of the present invention can adopt an annular peripheral border with a small section area and decrease the costs and the length of construction thereof.

The radiating cables of the reinforcing frame in the present invention does not require a large prestress and excessive flexibility.

In the dome shaped roof structure of the present invention, the tension which is directed towards the center and operates upon all of the radiating cables, uniformly thrusts up the connections of the steel members of the main frame by axial force of the strut members vertically disposed. That is, this is accomplished by the force which thrusts up the connections of the main frame from the rising of the strut members. Therefore, it is possible to decrease the weight required for the steel members in comparison with that of the double layer truss dome. The structural stability of the dome shaped roof structure of the present invention, with respect to snow deposited thereon or the like, is similar to that of the double layer truss dome formed by cable-reinforcing the main frame by using the reinforcing frame. Consequently, the dome shaped roof structure of the present invention can avoid the lack of stability of the main frame by using the single layer truss dome structure, and can achieve higher buckling strength in the steel members.

Preferably, in the dome shaped roof structure of the present invention, the reinforcing frame further comprises; first supplementary cables each of which is disposed between the upper ends of adjacent strut members on one of the circular cables, and a plurality of supplementary strut members that each have upper end connected to the steel member of the main frame and each lower end is supported by the first supplementary cable at approximately the center portion thereof, wherein a tension is introduced to the first supplementary cables so that the steel members of the main frame are thrust up by the supplementary strut members.

According to this structure, it is possible to evenly distribute the stress from the steel members of the main frame and, consequently, obtain a roof structure with higher structural stability.

Preferably, in the dome shaped roof structure of the present invention, the reinforcing frame further comprises; second supplementary cables extending in directions which traverse the radiating cables when viewed from above, and one end of each second supplementary cable is connected to the lower end of said strut member and the other end of each second supplementary cable is connected to the outer steel member of the main frame which is adjacent to the strut member.

According to this structure, it is possible to give approximately uniform reinforcement to every portion of the main frame because of introducing uniform tension to the entire reinforcing frame.

Preferably, in the dome shaped roof structure of the present invention, the main frame has a circular opening at the center thereof.

According to this structure, in order to make the inside of the stadium more comfortable, it is possible to provide an air conditioning equipment or the like, such as a smoke eliminating equipment, within the circular opening located at the center of the main frame.

Preferably, the dome shaped roof structure of the present invention, which is suitable for a stadium for indoor athletic sports, comprises: a main frame for covering the inside of the stadium, constructed by a plurality of steel members which are connected to one another in the form of a plane truss, which is arch shaped when viewed from the side and circularly shaped when viewed from above, and has a ring shaped peripheral border; a double layer truss for reinforcing the vicinity of the center of the main frame, constructed in a body with the main frame in the vicinity of the center of and in the inner side of the main frame, the double layer truss comprising a plurality of lower beams each of which is provided in a horizontal direction or in a downward depressed shape when viewed from the side and a plurality of vertical members provided between the steel members of the main frame and lower beams; and a reinforcing frame comprising a plurality of radiating cables constructed in the inner side of the main frame and extending radially from the periphery of the double layer truss when viewed from above, a plurality of circular cables provided concentrically with the peripheral border of the main frame, and a plurality of strut members that have each upper end connected to the steel member of the main frame at an intersecting point of the radiating cables and the circular cables, the strut members vertically supported by the radiating cables and the circular cables; wherein tension is introduced to the radiating cables in the external direction and the outer ends of the radiating cables are fixed with the main frame, so that the steel members of the main frame are thrust up by the strut members of the reinforcing frame.

In this structure, the double layer truss for supporting the vertical load, is constructed in a body with the main frame in the vicinity of the center of and inner side of the main frame, and the double layer truss comprises a plurality of lower chord members and a plurality of vertical members provided between the steel members of the main frame and the lower chord members. Therefore, it is possible to sufficiently reinforce the vicinity of the center of the main frame. It is also possible to hang various kinds of devices from the lower chord members of the double layer truss, such as illuminating devices, sound devices or the like which may be used in various events.

DETAILED DESCRIPTION OF THE PRESENT INVENTION

Hereinafter, the preferred embodiments of the present invention will be explained with reference to the attached drawings. A first embodiment of the dome shaped roof structure according to the present invention will be explained in detail in conjunction with FIGS. 1 through 12, as follows.

Figure 1:
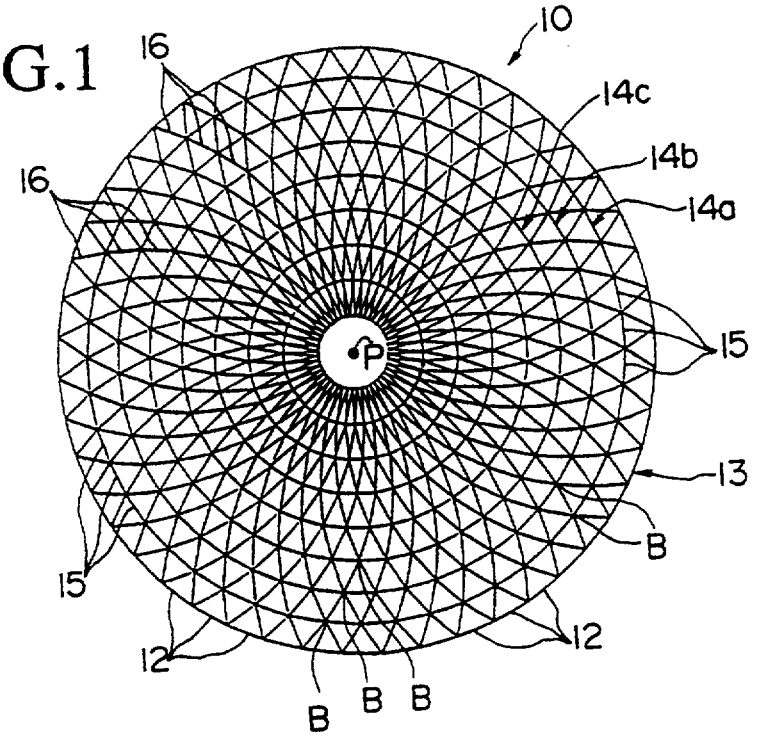
FIG. 1 is a schematic plan view showing a main frame of the dome shaped roof structure according to a first embodiment of the present invention.
Figure 2:
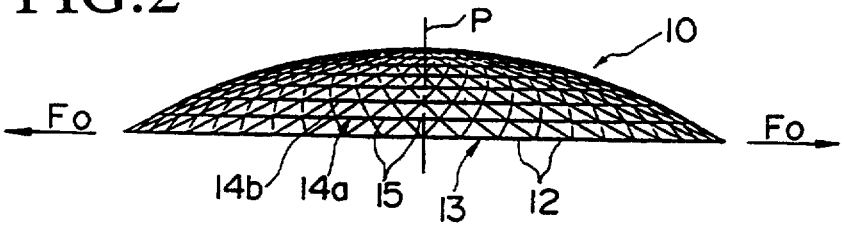
FIG. 2 is a side view showing a main frame in the first embodiment of the present invention.
Figure 3:
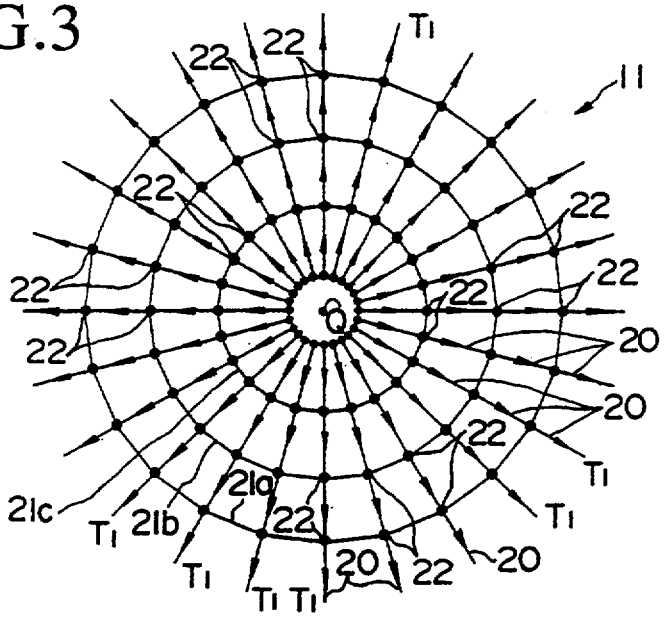
FIG. 3 is a schematic plan view showing a reinforcing frame in the first embodiment of the present invention.
Figure 4:
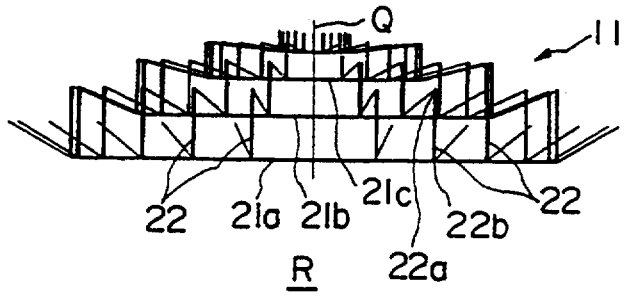
FIG. 4 is a schematic side view showing the reinforcing frame in the first embodiment of the present invention.
Figure 5:
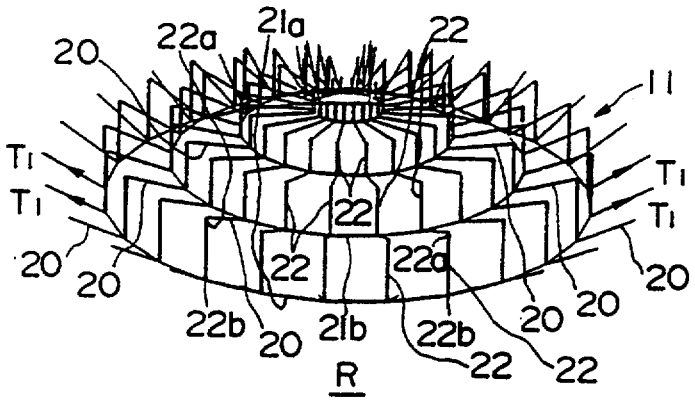
FIG. 5 is a schematic perspective view showing the reinforcing frame in the first embodiment of the present invention.

The dome shaped roof structure according to the present invention comprises a main frame 10 for covering the inside of the stadium constructed in an arch shape when viewed from the side and in a circular shape when viewed from above, as shown in FIGS. 1 and 2, and a reinforcing frame 11 constructed in the inner side of the main frame 10, as shown in FIGS. 3 through 5.

The main frame 10 is a lattice shaped structure which is constructed by a plurality of steel members connected to one another in the form of a plane truss, and has a diameter of about 200 m and a height of about 30 m. Consequently, the rise-to-span ratio is 0.15.

As shown in FIG. 1, a peripheral border ring 13 is provided at the lower periphery of the main frame 10, which is circularly shaped when viewed from above, by connecting a plurality of peripheral members 12 to one another.

Inside the peripheral border ring 13, 8 inner rings 14*a*, 14*b*, . . . each of which is formed by connecting a plurality of circumferential elements 15 to one another, are provided. The inner rings 14*a*, 14*b*, . . . and the peripheral border ring 13 have a central concentric point P. As the diameter of the inner rings 14*a*, 14*b*, . . . becomes smaller, i.e. as the inner rings 14*a*, 14*b*, . . . becomes nearer to the central concentric point P, the height thereof becomes larger.

A plurality of radiating members 16 extending in a radial direction, toward the central point P of the peripheral border ring 13, are provided to connect with one another, and to connect the inner rings 14*a*, 14*b*, . . . The radiating members 16 are radially connected to one another at the side adjacent to the central point P. The radiating members 16 are connected to one another in a direction which becomes nearer to the periphery of the rings 13 and 14 as the radiating members 16 are nearer to the peripheral border ring 13.

The peripheral members 12, the peripheral border ring 13, and the radiating members 16 are connected to one another in the form of a plane truss. Consequently, the main frame 10 which is circularly shaped when viewed from above and arch shaped when viewed from the side, is formed with a circular opening 17 at the center of the upper portion thereof. The peripheral border ring 13 provided at the periphery of the main frame 10 has a construction which supports thrust F1 in the direction of the arrow when viewed from the side, and is generated at the periphery of the main frame 10, that is, the force which pushes a facility (not shown) for supporting the main frame.

The reinforcing frame 11 comprises a plurality of radiating cables 20 . . . , a plurality of circular cables 21*a*, 21*b*, . . . , and a plurality of strut members 22 . . . , as the principal construction members, and is constructed in the inner side R of the facility of the main frame 10, as shown in FIGS. 3 through 5.

The plurality of circular cables 21*a*, 21*b*, . . . have a concentric central point Q. As the diameter of the circular cables 21*a*, 21*b*, . . . becomes smaller, i.e. as the circular cables 21*a*, 21*b*, . . . becomes near to the concentric central point Q, the height thereof becomes larger.

24 groups of radiating cables each of which comprises a plurality of radiating cable elements 20, . . . , which extend radially from the concentric central point Q when viewed from above, are disposed, as shown in FIG. 3. A plurality of strut members 22, . . . are provided at the points at which the groups of the radiating cables and the circular cables 21*a*, 21*b*, . . . intersect.

The upper end 22*a* of each strut members 22, . . . is connected in a rotatable manner to the connecting portion B of the circumferential element 15, and to the radiating member 16 which construct the main frame 10. The connecting portion B will simply be called a connecting portion of the main frame hereinafter. Each of the radiating cable elements 20, . . . has an outward angle of elevation outwardly. As the radiating cable element 20 becomes nearer to the peripheral border ring 13, the angle of elevation becomes larger. Each upper end 22*a* of the strut members 22, . . . is bound with each outer end of the radiating cable elements 20, . . . , and each lower end 22*b* of the strut members 22, . . . is bound with each inner end of the radiating cable elements 20, . . . The strut members 22, . . . are vertically disposed by introducing tension T1 in the external radiating direction, i.e. in the direction of the arrow shown in FIG. 3, to the radiating cable elements 20, . . . For example, the introduction of the tension T1 in the external radiating direction to the radiating cable elements 20, . . . is given by the force which is generated when the main frame 10 is spread by its empty weight. Therefore, the strut members 22 which are vertically disposed by the introduction of the tension T1 to the radiating cable elements 20, have a force which pushes up the connecting portion of the main frame 10 in reaction to the tension T1. The force pushing up the connecting portion will be called an axial force of the strut member hereinafter.

Then, the reinforcing frame 11 with the above-described construction is built by combining with the inside of the main frame 10, i.e. the R side in the facility, coinciding the central point P with the central point Q, as shown in FIGS. 6 to 9. All of the upper ends 22*a* of the strut members 22, . . . are connected in a rotatable manner to the connecting portion B of the main frame 10, the outer ends of the radiating cable elements 20, . . . are bound to the main frame, and the tension T1 is uniformly introduced to all of the radiating cables 20, . . . in the external radiating direction.

Figure 6:
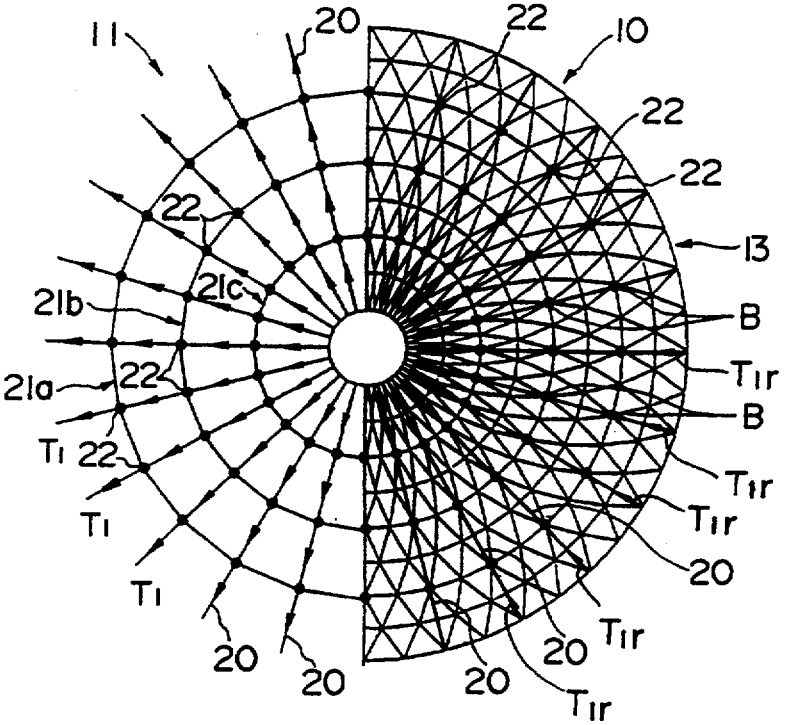
FIG. 6 is a schematic plan view showing a combination of the main frame and the reinforcing frame in the first embodiment of the present invention.
Figure 7:
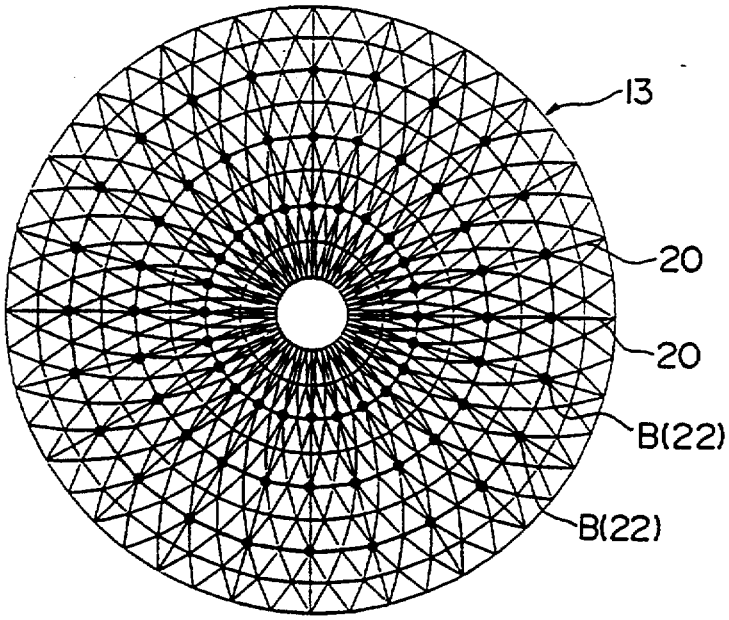
FIG. 7 is a schematic plan view showing a dome shaped roof structure according to the first embodiment of the present invention.
Figure 8:
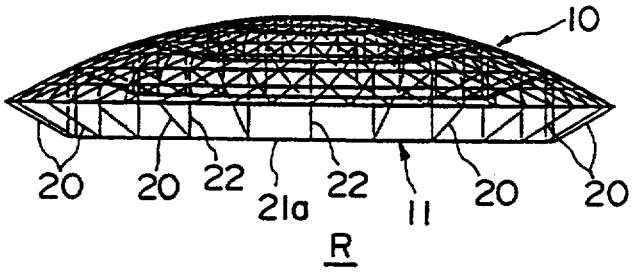
FIG. 8 is a schematic side view showing the dome shaped roof structure according to the first embodiment of the present invention.
Figure 9:
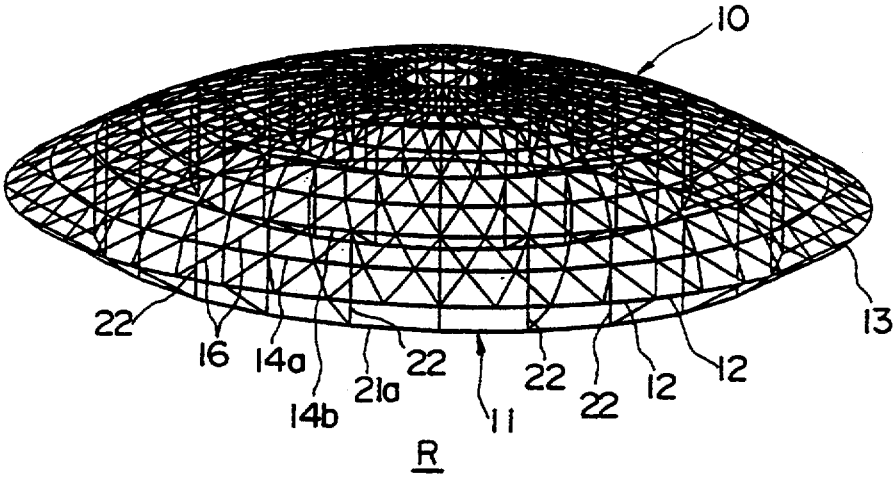
FIG. 9 is a schematic perspective view showing the dome shaped roof structure according to the first embodiment of the present invention.

In a single main frame 10, a thrust F0 is generated in the peripheral border ring 13 in the direction of the arrow as shown in FIG. 2. However, according to the dome shaped roof structure of the embodiment which comprises a combination of the main frame 10 and the reinforcing frame 11, the tension T1r, . . . directed to the central point Q is given to the peripheral border ring 13 of the main frame 10 as a reaction force against the tension T1 which is introduced to the radiating cable 20, as shown in FIG. 6. Consequently, the thrust imposed to the peripheral border ring 13 is decreased.

Since the axial force of the strut member 22 is distributed in the upward direction to the connecting portion B of the main frame 10, the connecting portion B is uniformly pushed up and held.

Since the tension T1r, . . . directed to the central point Q is imposed on the peripheral border ring 13 of the main frame 10 in reaction to the tension T1 which is introduced to the radiating cable 20, and the thrust imposed on the peripheral border ring 13 is decreased, the roof structure according to the embodiment does not require a steel material which has good tensile strength for the peripheral members 12 and the peripheral border ring 13.

Figure 10:
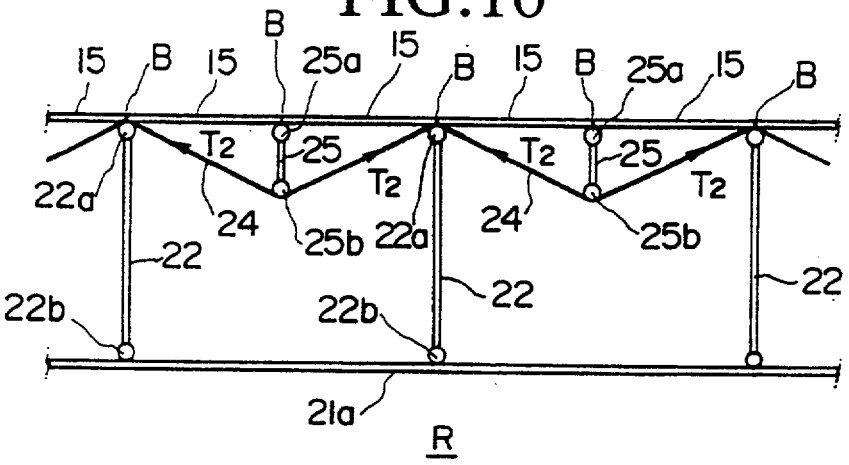
FIG. 10 is a view showing a state in which first supplementary cables and supplementary strut members are provided between the strut members in the dome shaped roof structure according to the present invention.

In the dome shaped roof structure according to this embodiment, first supplementary cables 24 which extend in the same direction as that of the circular cables 21*a*, 21*b*, . . . are installed between the upper ends 22*a*, 22*a* of adjacent strut members 22, 22 which are disposed along the circular cables 21*a*, 21*b*, . . . , as shown in FIG. 10. A supplementary strut member 25, which is shorter than the strut member 22 in length, is vertically disposed at the central portion between each adjacent strut members 22, 22. The lower end 25*b* of the supplementary strut member 25 is bound with the central portion of the first supplementary cables 24. The upper end 25*a* of the supplementary strut member 25 is connected in a rotatable manner to the connecting portion B of the main frame 10.

Tension is introduced to the first supplementary cables 24 in the same direction as the extending direction of the circular cables 21*a*, 21*b*, . . . using the supplementary strut member 25. Accordingly, the supplementary strut member 25 is pushed up, so that the axial force of the supplementary strut member 25 is given to the connecting portion B of the main frame 10 in the upward direction and, thereby, the connecting portion B is uniformly pushed up and held.

Consequently, the connecting portions B are uniformly pushed up by the axial force of the strut member 22 in reaction to the tension T1 of the radiating cable 20, and by the axial force of the supplementary strut member 25 due to the reaction force T2 against the tension of the first supplementary cable 24. Accordingly, the stress to the steel members which construct the main frame 10 such as the peripheral members 12, the circumferential elements 15, and the radiating members 16 is evenly distributed and the buckling strength of the entire roof structure is improved.

Figure 11:
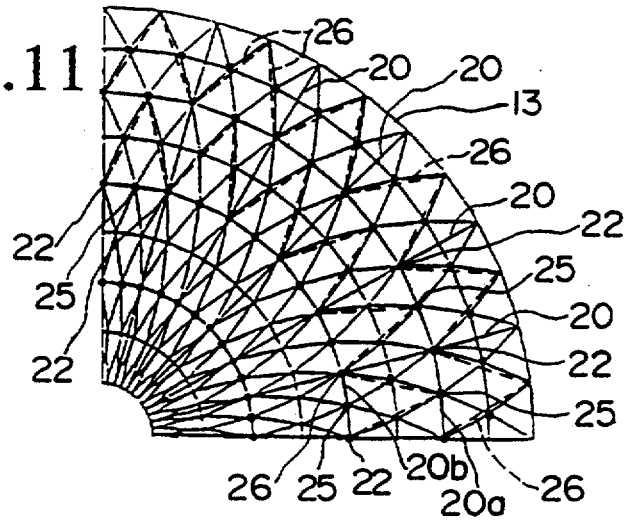
FIG. 11 is a schematic plan view showing a state in which second supplementary cables are provided in the dome shaped roof structure according to the present invention.
Figure 12:
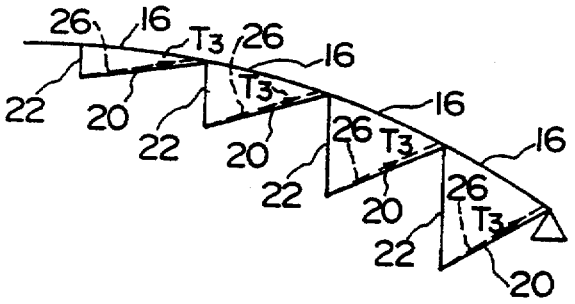
FIG. 12 is a schematic side view showing the state in which second supplementary cables are provided in the dome shaped roof structure according to the present invention.

In this embodiment, second supplementary cables 26, . . . are bound and stretched tightly between the lower end of the strut members 22 on one of the inner circular cables 21 and the upper end of the strut members 22, i.e. the connecting portion B of the main frame 10 on the adjacent outer one of the circular cables 21, as shown in FIGS. 11 and 12, so that two of the second supplementary cables 26, . . . which are indicated by broken lines and one of the circular cables 21*a*, 21*b*, . . . approximately form a triangle when viewed from above, as shown in FIG. 11. The second supplementary cables 26, . . . are bound with the connecting portion B of the main frame, and with tension T3 in the direction of the arrow, as shown in FIG. 11.

Consequently, the connecting portions B are uniformly pushed up by the axial force of the strut member 22 in reaction not only to the tension T1 of the radiating cable 20 but also in reaction to the tension T3 of the second supplementary cable 26. Accordingly, the stress to the steel members which construct the main frame 10 such as the peripheral members 12, the circumferential elements 15, and the radiating members 16 is evenly distributed and the buckling strength of the entire roof structure is improved.

As described above, the dome shaped roof structure according to the embodiment provides following advantages.

(1) The tension T1r, . . . directed to the central point P or Q is given to the peripheral border ring 13 of the main frame 10 in reaction to the tension T1 which is introduced to the radiating cable 20, so that the thrust imposed on the peripheral border ring 13 is decreased. Accordingly, it is possible to greatly decrease the construction costs for constructing the dome border of the main frame 10, i.e. the peripheral border ring 13.

(2) The dome shaped roof structure according to the embodiment is constructed by a combination of the main frame 10 which comprises a plurality of steel members e.g. the peripheral members 12, the circumferential elements 15 and the radiating members 16, connected to one another in the form of plane truss, and the reinforcing frame 11 constructed in the inner side R of the main frame. Since the connecting portion B of the main frame 10 is uniformly pushed up by the axial force of the strut member 22 which is given by the reaction force against the tension T1 introduced into the whole radiating cables 20, . . . Therefore, it is possible to obtain a dome shaped roof structure which has high structural stability and high buckling strength.

(3) Tension is introduced to the first supplementary cables 24 in the same direction as the extending direction of the circular cables 21*a*, 21*b*, . . . using the supplementary strut member 25. Accordingly, the supplementary strut member 25 is pushed up, so that the axial force of the supplementary strut member 25 is given to the connecting portion B of the main frame 10 in the upward direction and, thereby the connecting portion B is uniformly pushed up and held. The connecting portions B of the main frame 10 are uniformly pushed up by the axial force of the strut member 22 in reaction to the tension T1 of the radiating cable 20, and by the axial force of the supplementary strut member 25 due to the reaction force T2 against the tension of the first supplementary cable 24. Accordingly, the stress to the steel members which construct the main frame 10 such as the peripheral members 12, the circumferential elements 15 and the radiating members 16 is evenly distributed, and the buckling strength of the entire roof structure is improved.

(4) In the embodiment, second supplementary cables 26, . . . are bound and stretched tightly between the lower end of the strut members 22 on one of the inner circular cables 21 and the connecting portion B of the main frame 10 on one of the adjacent outer circular cables 21, together with a tension T3. Consequently, the connecting portions B are uniformly pushed up by the axial force of the strut member 22 in reaction to not only to the tension T1 of the radiating cable 20, but also in reaction to the tension T3 of the second supplementary cable 26. Accordingly, the stress to the steel members which construct the main frame 10 such as the peripheral members 12, the circumferential elements 15 and the radiating members 16 is evenly distributed, and the buckling strength of the entire roof structure is improved.

Air conditioning equipment, such as smoke eliminating equipment, may be provided at the circular opening 17 of the center of the main frame 10. Accordingly, it is possible to make the inside space R of the facility a more comfortable environment.

A second embodiment of the dome shaped roof structure according to the present invention, will be explained in detail in conjunction with FIGS. 13 through 22.

In these Figures, the same numerals are attached for the same members, the same portions or the like as those of the first embodiment.

Figure 13:
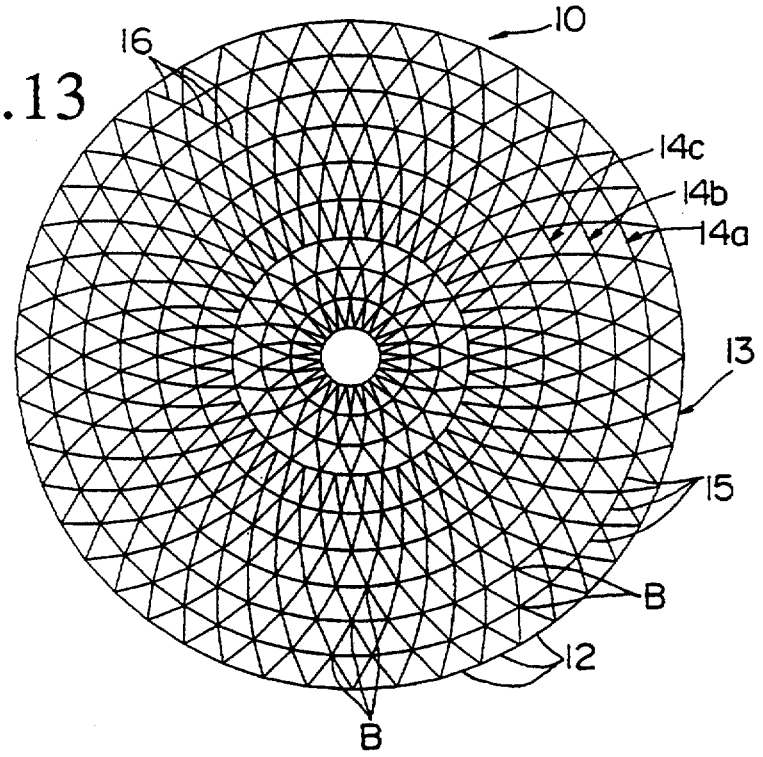
FIG. 13 is a schematic plan view showing a main frame of the dome shaped roof structure according to a second embodiment of the present invention.
Figure 14:
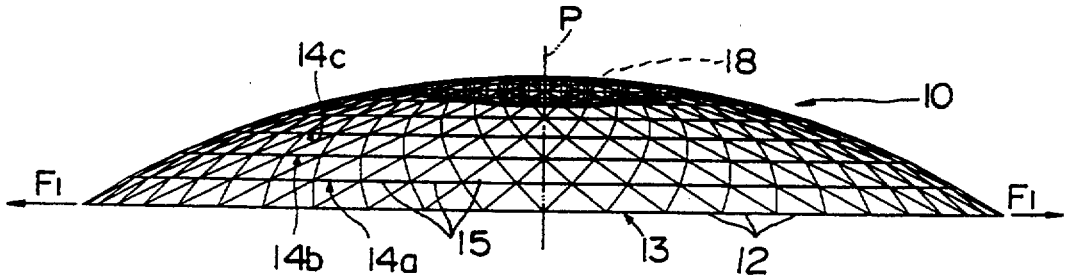
FIG. 14 is a side view showing the main frame in the second embodiment of the present invention.
Figure 15:
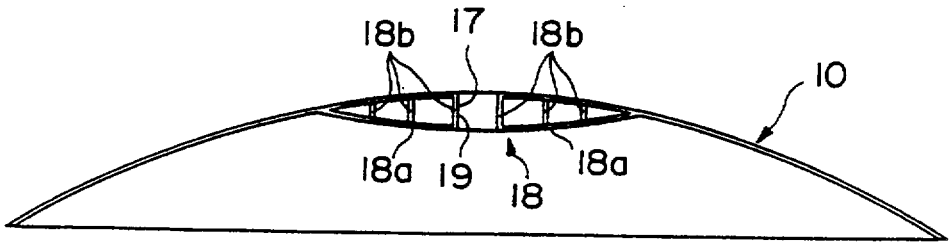
FIG. 15 is a side sectional view showing the main frame having a double layer truss in the second embodiment of the present invention.
Figure 16:
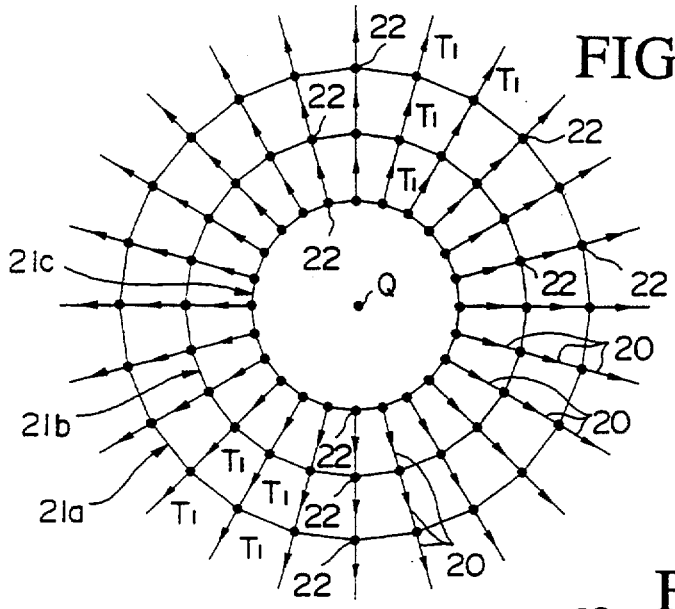
FIG. 16 is a schematic plan view showing a reinforcing frame in the second embodiment of the present invention.
Figure 17:
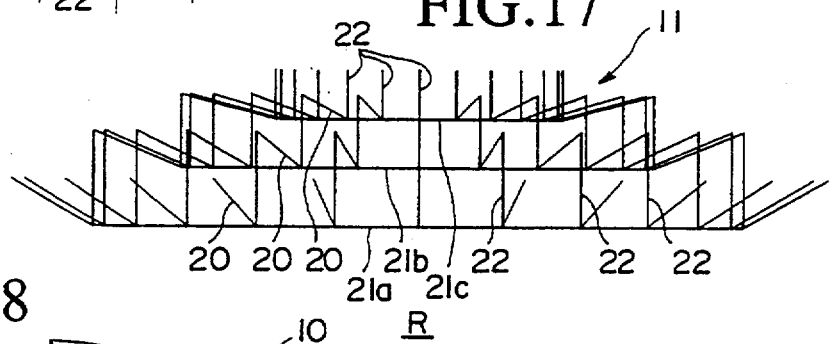
FIG. 17 is a schematic side view showing the reinforcing frame in the second embodiment of the present invention.
Figure 18:
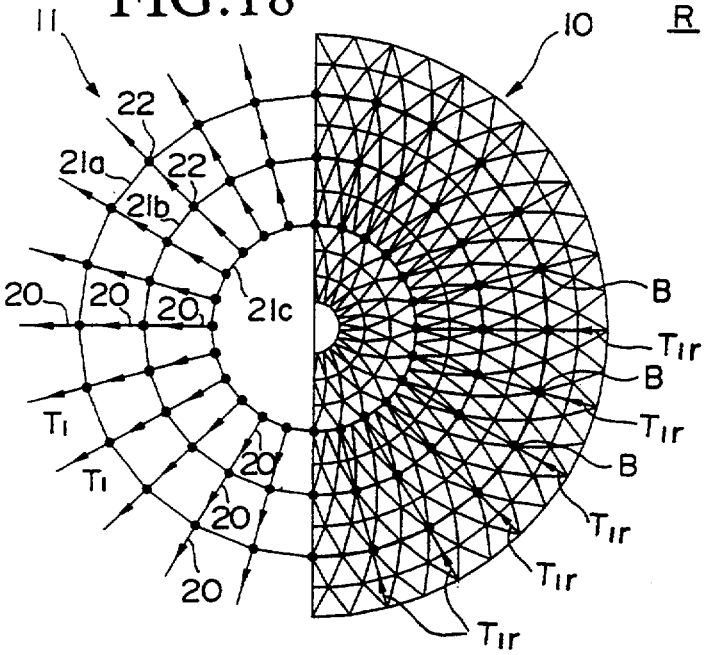
FIG. 18 is a schematic plan view showing a combination of the main frame, the double layer truss and the reinforcing frame in the second embodiment of the present invention.
Figure 19:
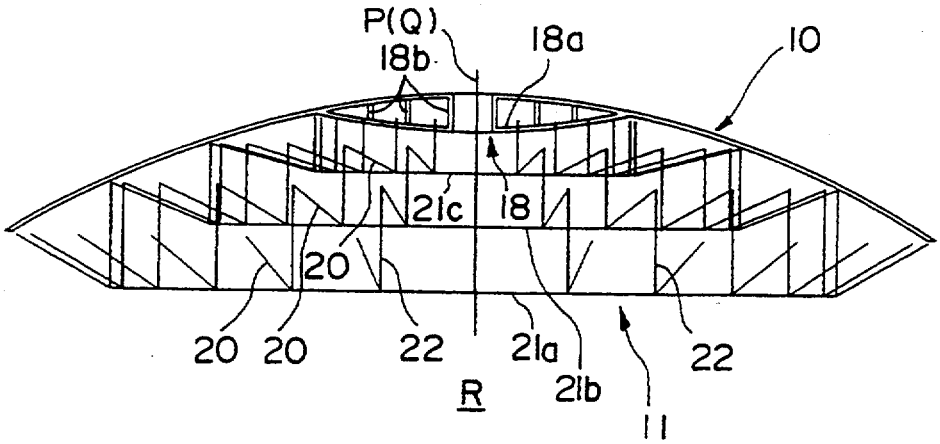
FIG. 19 is a schematic side sectional view showing the dome shaped roof structure according to the second embodiment of the present invention.
Figure 20:
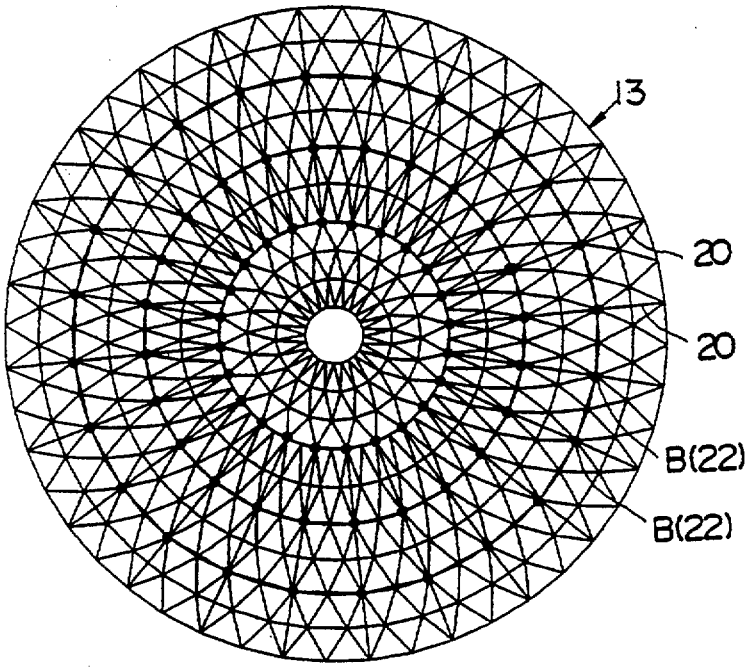
FIG. 20 is a schematic plan view showing the dome shaped roof structure according to the second embodiment of the present invention.
Figure 21:
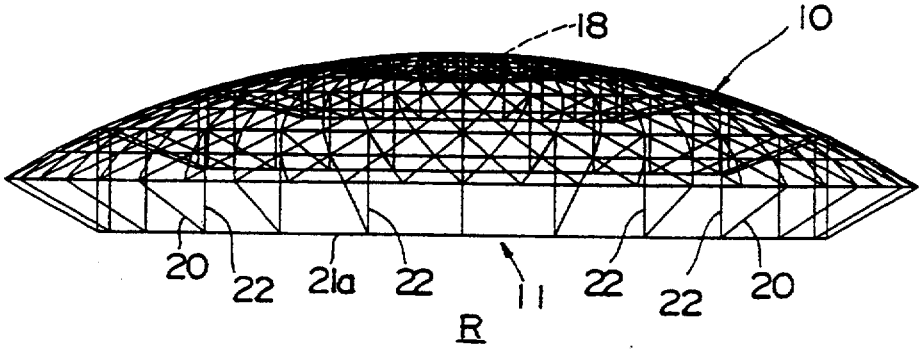
FIG. 21 is a schematic side view showing the dome shaped roof structure according to the second embodiment of the present invention.
Figure 22:
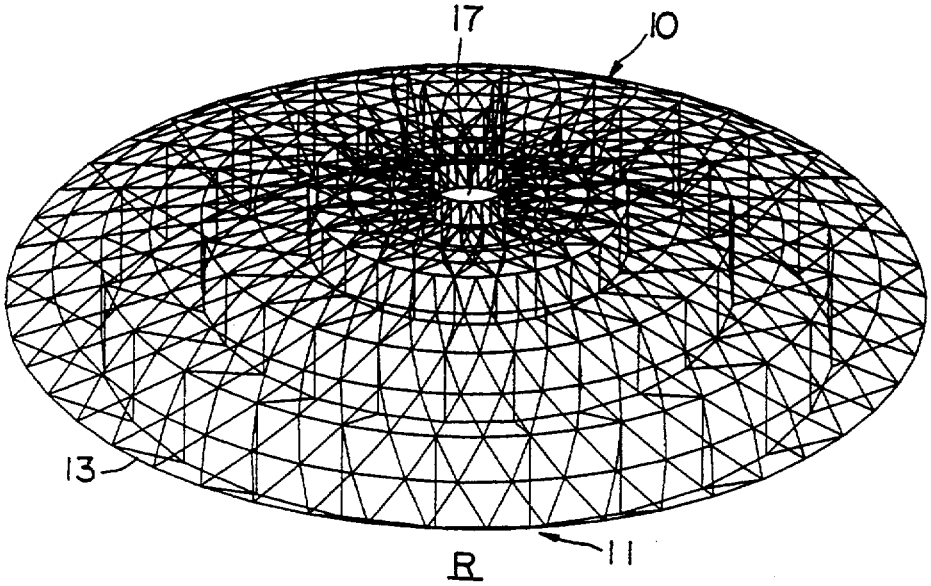
FIG. 22 is a schematic perspective view showing the dome shaped roof structure according to the second embodiment of the present invention.
Figure 23:
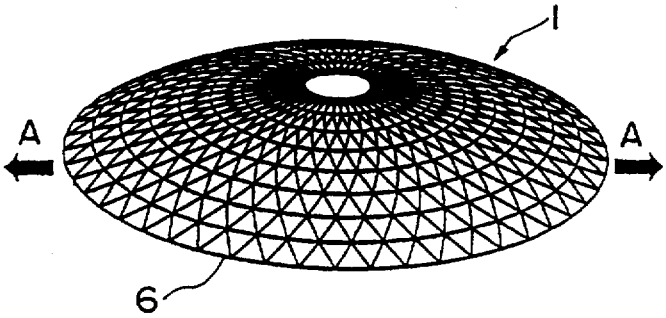
FIG.23 (PRIOR ART)
FIG. 23 is a view showing a conventional dome shaped roof structure which has a single layer truss structure.
Figure 24:
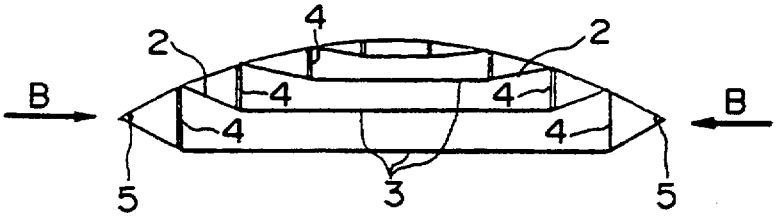
FIG.24 (PRIOR ART)
FIG. 24 is a view showing a conventional dome shaped roof structure which has a cable structure.

The dome shaped roof structure according to the second embodiment comprises a main frame 10 for covering the inside of the stadium which is arch shaped when viewed from the side and circularly shaped when viewed from above, as shown in FIGS. 13 and 14, and has a double layer truss 18 for reinforcing the vicinity of the center of the main frame, which is constructed in a body with the main-frame 10 in the vicinity of the center of and in the inner side of the main frame 10, as shown in FIGS. 15, and a reinforcing frame 11 constructed in the inner side of the main frame 10, as shown in FIGS. 16 through 19.

What distinguishes the dome shaped roof structure of the second embodiment from that of the first embodiment is that the main frame 10 in the second embodiment is provided with a double layer truss 18 constructed in a body with the main frame 10 in the vicinity of the center of and in the inner side of the main frame 10, and that the reinforcing frame 11 in the second embodiment is provided with a center opening larger than that of the first embodiment. The center opening of the reinforcing frame 11 in the second embodiment corresponds to the double layer truss 18 in size. Aside from these points, all parts of the structure are approximately identical to those of the first embodiment.

As shown in FIGS. 13 to 15, the main frame 10 is a lattice shaped structure which is constructed by a plurality of steel members connected to one another in the form of a plane truss and has a diameter of about 200 m and a height of about 30 m. Consequently, the rise-to-span ratio is 0.15.

A peripheral border ring 13 is provided at the outer border of the main frame 10 which is circularly shaped when viewed from above, by connecting a plurality of peripheral members 12 to one another, as shown in FIG. 13.

The double layer truss 18 is constructed in a body with the main frame 10 in the vicinity of the center of and in the inner side R of the main frame 10, as shown in FIG. 15. That is, the double layer truss 18 comprises the center portion of the main frame 10, a plurality of lower beams **18*a* each of which is disposed in a downward depressed shape which is symmetrical to the upward depressed shape of the center portion of the main frame 10 when viewed from the side; and a plurality of vertically extended members 18*b*, which are disposed between the lower beams 18*a* and the steel members of the main frame 10 comprising the peripheral members 12, the circumferential elements 15 and the radiating members 16. The double layer truss 18 is provided with a circular opening 19 at the center of the upper portion thereof, which corresponds to the circular opening 17 at the center of the main frame. The lower beams 18*a*** may be provided with a structure so that each extends in a horizontal direction, and is not in a downward depressed shape.

The reinforcing frame 11 comprises a plurality of radiating cables 20 . . . , a plurality of circular cables **21*a*, 21*b*, . . . , and a plurality of strut members 22 . . . , as the principal construction members, and is constructed in the inner side R of the facility of the main frame 10, as shown in FIGS. 16 through 19. The center opening of the reinforcing frame 11 in the second embodiment is larger than that of the first embodiment and corresponds to the double layer truss 18** in size.

In this structure, since the double layer truss 18 is provided in the center portion of the main frame 10, the vertical load which is loaded at the connecting portions B of the center portion of the main frame 10 can be supported thereby. That is, the center portion of the main frame 10 is reinforced by the double layer truss 18. Since the axial force of the strut member 22 is given in the upward direction to the connecting portions B which are outside of the center portion of the main frame 10, the connecting portions B outside of the center portion are uniformly pushed up and held thereby.

As described above, the dome shaped roof structure according to the second embodiment provides not only the aforementioned advantages according to the first embodiment but also the following additional advantages.

In the dome shaped roof structure according to the second embodiment, the double layer truss 18 for supporting the vertical load, is constructed in a body with the main frame 10 in the vicinity of the center of and inner side R of the main frame 10, and the double layer truss comprises a plurality of lower chord members **18*a* and a plurality of vertical members 18*b* provided between the steel members of the main frame 10 and the lower chord members 18*a*. Therefore, it is possible to sufficiently reinforce the vicinity of the center of the main frame 10. In addition, it is possible to hang various kinds of devices, such as illuminating devices, sound devices or the like which may be used in various events from the lower chord members 18*a* of the double layer truss 18**.

Air conditioning equipment, such as smoke eliminating equipment, may be provided at the circular opening 17 of the center of the main frame 10 or at the circular opening 19 of the double layer truss 18. Accordingly, it is possible to make the inside space R of the facility a more comfortable environment.

As described above, according to the dome shaped roof structure of the present invention, since the outer ends of the radiating cables are fixed with the main frame, while introducing a tension in an external direction no the radiating cables, a tension in an internal direction operates upon the radiating cables and the periphery of the main frame fixed therewith, as in reaction to the thrust generated in the annular peripheral border of the main frame. The thrust given to the annular peripheral border is decreased to relieve the load of the peripheral border. Therefore, the dome shaped roof structure of the present invention can adopt an annular peripheral border with a small section area and decrease the costs and length of construction thereof.

The radiating cables of the reinforcing frame in the present invention does not require a large prestress and excessive flexibility.

In the dome shaped roof structure of the present invention, the tension in the internal direction operating upon all of the radiating cables thrusts up the connections of the steel members of the main frame uniformly by axial force of the vertically disposed strut members, i.e., by force which thrusts up the connections of the main frame by raising the strut members. Therefore, it is possible to decrease the weight required for the steel members in comparison with that of the double layer truss dome. The structural stability of the dome shaped roof structure of the present invention, with respect to snow deposited on the roof or the like, is similar to that of the double layer truss dome formed by cable-reinforcing the main frame by using the reinforcing frame. Consequently, the dome shaped roof structure of the present invention can avoid the lack of stability of the main frame by using the single layer truss dome structure and can achieve higher buckling strength of the steel members.

According to the dome shaped roof structure of the present invention which utilizes the reinforcing frame further comprising first supplementary cables each of which is provided between the upper ends of adjacent strut members on one of the circular cables, it is possible to make the stresses of the steel members of the main frame uniform and obtain a roof structure having higher structural stability.

The dome shaped roof structure of the present invention utilizes the reinforcing frame further comprising second supplementary cables extending in traverse directions to the radiating cables, when viewed from above, and has one end of each second supplementary cable connected to the lower end of said strut member and the other end of each second supplementary cable connected to the outer steel member of the main frame which is adjacent to the strut member. Consequently, according to this structure, it is possible to give approximately uniform reinforcement to every portion of the main frame because of introducing uniform tension to the entire reinforcing frame.

The dome shaped roof structure of the present invention utilizes a main frame comprising a double layer truss for reinforcing which is constructed in a body with the main frame in the vicinity of the center of and inner side of the main frame, and the double layer truss comprising a plurality of lower chord members and a plurality of vertical members provided between the steel members of the main frame and the lower chord members. Consequently, it is possible to sufficiently reinforce the vicinity of the center of the main frame. In addition, it is possible to hang various kinds of devices, such as illuminating devices, sound devices or the like which may be used in various events from the lower chord members of the double layer truss.

What is claimed is:

1. A dome shaped roof structure suitable for use in the construction of a stadium for indoor athletic sports comprising:

a main frame for covering the inside of the stadium, constructed by a plurality of steel members which are connected to one another in the form of plane truss, which is arch shaped when viewed from the side and circularly shaped when viewed from above, and has a ring shaped peripheral border; and a reinforcing frame comprising a plurality of radiating cables constructed in the inner side of the main frame and extending radially from the central portion of the main frame to the periphery when viewed from above, a plurality of circular cables provided concentrically with the peripheral border of the main frame, and a plurality of strut members that have each upper end connected to the steel member of the main frame at an intersecting point of the radiating cables and the circular cables, the strut members being vertically supported by the radiating cables and the circular cables;

wherein tension is introduced to the radiating cables in the external direction and the outer ends of the radiating cables are fixed with the main frame, so that the steel members of the main frame are thrust up by the strut members of the reinforcing frame.

2. A dome shaped roof structure as claimed in claim 1, wherein said reinforcing frame further comprising; first supplementary cables each of which is disposed between the upper ends of adjacent strut members on one of said circular cables, and a plurality of supplementary strut members that have each upper end connected to said steel member of the main frame and each lower end is supported by said first supplementary cable at approximately the center portion thereof, wherein a tension is introduced to the first supplementary cables so that the steel members of the main frame are thrust up by the supplementary strut members.

3. A dome shaped roof structure as claimed in claim 1, wherein said reinforcing frame further comprising second supplementary cables extending in directions which traverse said radiating cables when viewed from above, and one end of each second supplementary cable is connected to the lower end of said strut member and the other end of each second supplementary cable is connected to the outer steel member of the main frame which is adjacent to said strut member.

4. A dome shaped roof structure as claimed in claim 1, wherein said main frame has a circular opening at the center thereof.

5. A dome shaped roof structure suitable for a stadium for indoor athletic sports comprising:

a main frame for covering the inside of the stadium, constructed by a plurality of steel members which are connected to one another in the form of a plane truss, which is arch shaped when viewed from the side and circularly shaped when viewed from above, and has a ring shaped peripheral border;

a double layer truss for reinforcing the vicinity of the center of the main frame, constructed in a body with the main frame in the vicinity of the center of and in the inner side of the main frame, the double layer truss comprising a plurality of lower beams each of which is provided in a horizontal direction or in a downward depressed shape when viewed from the side and a plurality of vertical members provided between said steel members of the main frame and lower beams; and a reinforcing frame comprising a plurality of radiating cables constructed in the inner side of the main frame and extending radially from the periphery of said double layer truss when viewed from above, a plurality of circular cables provided concentrically with the peripheral border of the main frame, and a plurality of strut members that have each upper end connected to the steel member of the main frame at an intersecting point of the radiating cables and the circular cables, the strut members vertically supported by the radiating cables and the circular cables;

wherein a tension is introduced to the radiating cables in the external direction and the outer ends of the radiating cables are fixed with the main frame, so that the steel members of the main frame are thrust up by the strut members of the reinforcing frame.

6. A dome shaped roof structure as claimed in claim 5, wherein said reinforcing frame further comprising; first supplementary cables each of which is provided between the upper ends of adjacent strut members on one of said circular cables, and a plurality of supplementary strut members that have each upper end connected to said steel member of the main frame and each lower end supported by said first supplementary cable at approximately the center portion thereof, wherein tension is introduced to the first supplementary cables so that the steel members of the main frame are thrust up by the supplementary strut members.

7. A dome shaped roof structure as claimed in claim 5, wherein said reinforcing frame further comprising second supplementary cables extending directions which traverse said radiating cables when viewed from above, and one end of each second supplementary cable is connected to the lower end of said strut member and the other end of each second supplementary cable is connected to the outer steel member of the main frame which is adjacent to said strut member.

8. A dome shaped roof structure as claimed in claim 5, wherein said main frame has a circular opening portion at the center thereof.

9. A dome shaped roof structure suitable for use in the construction of a stadium for indoor athletic sports comprising:

a main frame for covering the inside of the stadium, constructed by a plurality of steel members which are connected to one another in the form of plane truss, which is arch shaped when viewed from the side and circularly shaped when viewed from above, and has a ring shaped peripheral border; and a reinforcing frame comprising a plurality of radiating cables constructed in the inner side of the main frame and extending radially to the periphery of the main frame when viewed from above, a plurality of circular cables provided concentrically with the peripheral border of the main frame, and a plurality of strut members that have each upper end connected to the steel member of the main frame at an intersecting point of the radiating cables and the circular cables, the strut members being vertically supported by the radiating cables and the circular cables;

wherein tension is introduced to the radiating cables in the external direction and the outer ends of the radiating cables are fixed with the main frame, so that the steel members of the main frame are thrust up by the strut members of the reinforcing frame.

10. A dome shaped roof structure as claimed in claim 9, wherein said reinforcing frame further comprising; first supplementary cables each of which is disposed between the upper ends of adjacent strut members on one of said circular cables, and a plurality of supplementary strut members that have each upper end connected to said steel member of the main frame and each lower end is supported by said first supplementary cable at approximately the center portion thereof, wherein a tension is introduced to the first supplementary cables so that the steel members of the main frame are thrust up by the supplementary strut members.

11. A dome shaped roof structure as claimed in claim 9, wherein said reinforcing frame further comprising second supplementary cables extending in direction which traverse said radiating cables when viewed from above, and one end of each second supplementary cable is connected to the lower end of said strut member and the other end of each second supplementary cable is connected to the outer steel member of the main frame which is adjacent to said strut member.

12. A dome shaped roof structure as claimed in claim 9, wherein said main frame has a circular opening at the center thereof.

* * * * *